US010125500B2

(12) United States Patent
Sisler et al.

(10) Patent No.: US 10,125,500 B2
(45) Date of Patent: Nov. 13, 2018

(54) PROTECTIVE AND DECORATIVE DECK COVERING

(71) Applicants: Terry Sisler, Avon, OH (US); William R. Gribble, Akron, OH (US)

(72) Inventors: Terry Sisler, Avon, OH (US); William R. Gribble, Akron, OH (US)

( * ) Notice: Subject to any disclaimer, the term of this patent is extended or adjusted under 35 U.S.C. 154(b) by 0 days.

(21) Appl. No.: 15/006,252

(22) Filed: Jan. 26, 2016

(65) Prior Publication Data

US 2016/0215506 A1 Jul. 28, 2016

Related U.S. Application Data

(60) Provisional application No. 62/107,862, filed on Jan. 26, 2015.

(51) Int. Cl.
*E04F 15/02* (2006.01)

(52) U.S. Cl.
CPC .. *E04F 15/02183* (2013.01); *E04F 15/02155* (2013.01); *E04F 15/02172* (2013.01)

(58) Field of Classification Search
CPC ..... E04F 15/02183; E04F 15/02155; E04F 15/02172; E04F 15/02161
USPC .... 52/177–182, 309.1, 309.14, 511, 650.3, 3
See application file for complete search history.

(56) References Cited

U.S. PATENT DOCUMENTS

D279,607 S * 7/1985 Rutter ..... E04B 1/003 D25/69
4,848,049 A * 7/1989 Hanson ..... E04B 1/70 52/97
4,885,882 A * 12/1989 Forshee ..... B63B 3/48 52/177
4,907,387 A 3/1990 Turnbull ..... 52/177
4,928,443 A * 5/1990 Goodman ..... E04D 13/1407 47/32
5,070,664 A 12/1991 Groh et al. ..... 52/177
5,394,667 A * 3/1995 Nystrom ..... E01D 19/125 52/263
5,479,750 A * 1/1996 Carlberg ..... E04B 5/12 428/192
5,794,390 A * 8/1998 Oliveri ..... E04F 11/1836 256/1
5,817,399 A * 10/1998 Kalman ..... B61D 23/00 427/180
5,913,784 A * 6/1999 Hite ..... E01O 5/22 52/177

(Continued)

FOREIGN PATENT DOCUMENTS

WO WO 2014130507 A1 * 8/2014 ..... C09J 7/00

OTHER PUBLICATIONS

International Search Report PCT/US2016/014730.

*Primary Examiner* — Theodore V Adamos
(74) *Attorney, Agent, or Firm* — Alvin T. Rockhill

(57) ABSTRACT

The subject invention discloses a deck covering having a top surface, a bottom surface, a front side longitudinal edge and a back side longitudinal edge, wherein the deck covering is comprised of a thermoplastic material, wherein the top surface is textured to provide a non-slip surface, wherein the bottom surface is covered with a peel and stick adhesive, wherein the front side longitudinal edge is curved downwardly, and wherein the back side longitudinal edge is curved downwardly. The peel and stick adhesive is preferably a butyl rubber adhesive which is preferably heavily loaded with carbon black.

19 Claims, 6 Drawing Sheets

(56) References Cited

U.S. PATENT DOCUMENTS 6,074,729 A * 6/2000 Watanabe ..... C09J 7/0246 428/212
6,233,886 B1 * 5/2001 Andres ..... E01C 5/005 114/267
6,449,911 B1 * 9/2002 Hudson ..... B63B 35/816 52/58
6,453,630 B1 9/2002 Buhrts et al. ..... 52/177
6,584,748 B2 7/2003 Bresnahan ..... 52/650.3
6,688,054 B2 2/2004 Pasterchick ..... 52/177
7,007,437 B2 3/2006 Thomas ..... 52/650.3
7,441,378 B2 10/2008 Wood ..... 52/177
7,578,251 B1 8/2009 Gribble ..... 114/85
7,793,469 B2 * 9/2010 Murphy, Jr. ..... B29C 47/0019 52/177
2004/0200158 A1 * 10/2004 Nelsen ..... E04B 1/003 52/169.1
2005/0022927 A1 2/2005 O'Connor ..... 156/249
2005/0043468 A1 2/2005 Fisher ..... 524/502
2005/0178071 A1 * 8/2005 Wood ..... E04F 15/02 52/3
2006/0101785 A1 * 5/2006 Wiercinski ..... E04C 3/14 52/793.1
2006/0156640 A1 * 7/2006 Thomas ..... E04F 15/02183 52/58
2008/0213526 A1 * 9/2008 Serra ..... C09J 7/02 428/41.8
2010/0037548 A1 * 2/2010 Kalkanoglu ..... B29C 47/046 52/309.1
2010/0132276 A1 * 6/2010 Landry ..... E04F 15/00 52/177
2014/0360117 A1 * 12/2014 Ko ..... E04F 15/02016 52/309.1
2014/0363621 A1 * 12/2014 Ngo ..... E04B 1/66 428/119

* cited by examiner

PROTECTIVE AND DECORATIVE DECK COVERING

The benefit of U.S. Provisional Patent Application Ser. No. 62/107,862 filed on Jan. 26, 2015 is claimed hereby. The teachings of U.S. Provisional Patent Application Ser. No. 62/107,862 are incorporated herein by reference in their entirety.

FIELD OF THE INVENTION

The present invention relates to deck coverings which can be affixed to deck surfaces. The coverings of this invention are comprised of several polymers; including thermoplastic material, and a butyl rubber adhesive which has been heavily loaded with carbon black, and a plasticizer. The deck coverings can be manufactured using various coloring agents, and various designs imprinted onto the top surface.

BACKGROUND OF THE INVENTION

Decks made from plastic, wood, or composite materials require continuous maintenance to protect against deterioration and/or discoloration which is caused by the elements. For example, composite and plastic decks can require finishing (water sealing, stain, varnish, lacquer, wax, etc.) to be applied once or twice a year to prevent fading. Similarly, wood decks with finishing require regular applications to retain their vibrant color. Decks without finishing still demand frequent maintenance because they are more susceptible to rotting and warping than finished decks. Accordingly, most of today's decks can quickly become time consuming and expensive investments.

There is a demand for decks which can be more easily maintained than plastic, wood, or composite decks. There is also a demand for decks which are fade and rot resistant, and which do not crack, warp or splinter. In the past, manufacturers were unable to meet this demand by using deck coverings, because no known material could supply adequately permanent adhesion to the deck surfaces.

SUMMARY OF THE INVENTION

The deck coverings of this invention can be applied to decks made from any material, including: wood, plastic, composite materials, or metal. The coverings can be made to imitate various textures by imprinting designs or patterns onto the upper side of the covering during its manufacture, and by adding dyes or other coloring agents. The deck covering textures can include lines, stripes, borders, margins, lettering, logos, and patterns which allow the coverings to simulate wood. More specifically, the deck coverings can be made to simulate cedar, redwood, douglas fir, yellow pine and a multitude of other wood deck paneling. Imprinted designs can be aesthetically pleasing, they can serve a utility function, and they can increase the overall safety of the deck by providing a non-slip surface in both wet and dry conditions.

The deck coverings of this invention are highly water resistant and can shield the underlying deck from water damage and consequential warping. Furthermore, the coverings are easily washable, and they are stain, mar and scuff resistant. Additionally, the covering's "peel-and-stick" design, and availability in both standardized and non-standardized sizes makes them easy to assemble and affix onto deck surfaces. The coverings have curved longitudinal edges, which allow them to cover the surface of the deck planks in their entirety; thereby providing a more visually appealing deck, and offering a means to direct water away from the underlying deck substrate.

Applying these deck coverings will transform a deck which requires frequent, expensive and time consuming maintenance, into a deck that will retain its vibrant appearance and functionality over a long period of time and with minimal effort.

The deck coverings of this invention more specifically disclose a deck covering having a top surface, a bottom surface, a front side longitudinal edge and a back side longitudinal edge, wherein the deck covering is comprised of a thermoplastic material, wherein the top surface is textured to provide a non-slip surface, wherein the bottom surface is covered with a peel and stick adhesive, wherein the front side longitudinal edge is curved downwardly, and wherein the back side longitudinal edge is curved downwardly.

The non-migrating plasticizer will typically be present in the plastic composition at a level which is within the range of about 5 php to about 60 php (parts per hundred parts by weight of plastic). At levels of less than about 5 php, strips of the simulated wood may not have sufficient flexibility to conform to irregular surfaces. At levels of greater than about 60 php the composition becomes too soft and is not durable enough for utilization as a deck covering. It is typically preferred for the non-migrating plasticizer to be present in the plastic composition at a level which is within the range of about 10 php to about 30 php.

This invention also discloses a deck which is comprised of a support structure and a plurality of planks which form the surface of the deck, wherein the upper surface of the planks are covered with deck covering strips having a top surface, a bottom surface, a front side longitudinal edge and a back side longitudinal edge, wherein the deck covering is comprised of a thermoplastic material, wherein the top surface is embossed to provide a non-slip surface, wherein the front side longitudinal edge of the strips are curved downwardly over the planks, and wherein the back side longitudinal edge of the strips are curved downwardly over the planks.

This invention further reveals a method of covering deck planks which form the surface of a deck with a protective and decorative covering, said method comprising (1) providing a plurality of the deck covering strips, wherein the deck covering strips are adapted to cover the planks of the deck; (2) removing the protective liner from said strips to expose the adhesive, (3) bringing the adhesive on the covering strips into contact with the planks, (4) allowing the simulated wood deck covering strips to adhere to the planks of the deck.

DETAILED DESCRIPTION OF THE INVENTION

Figure 1:
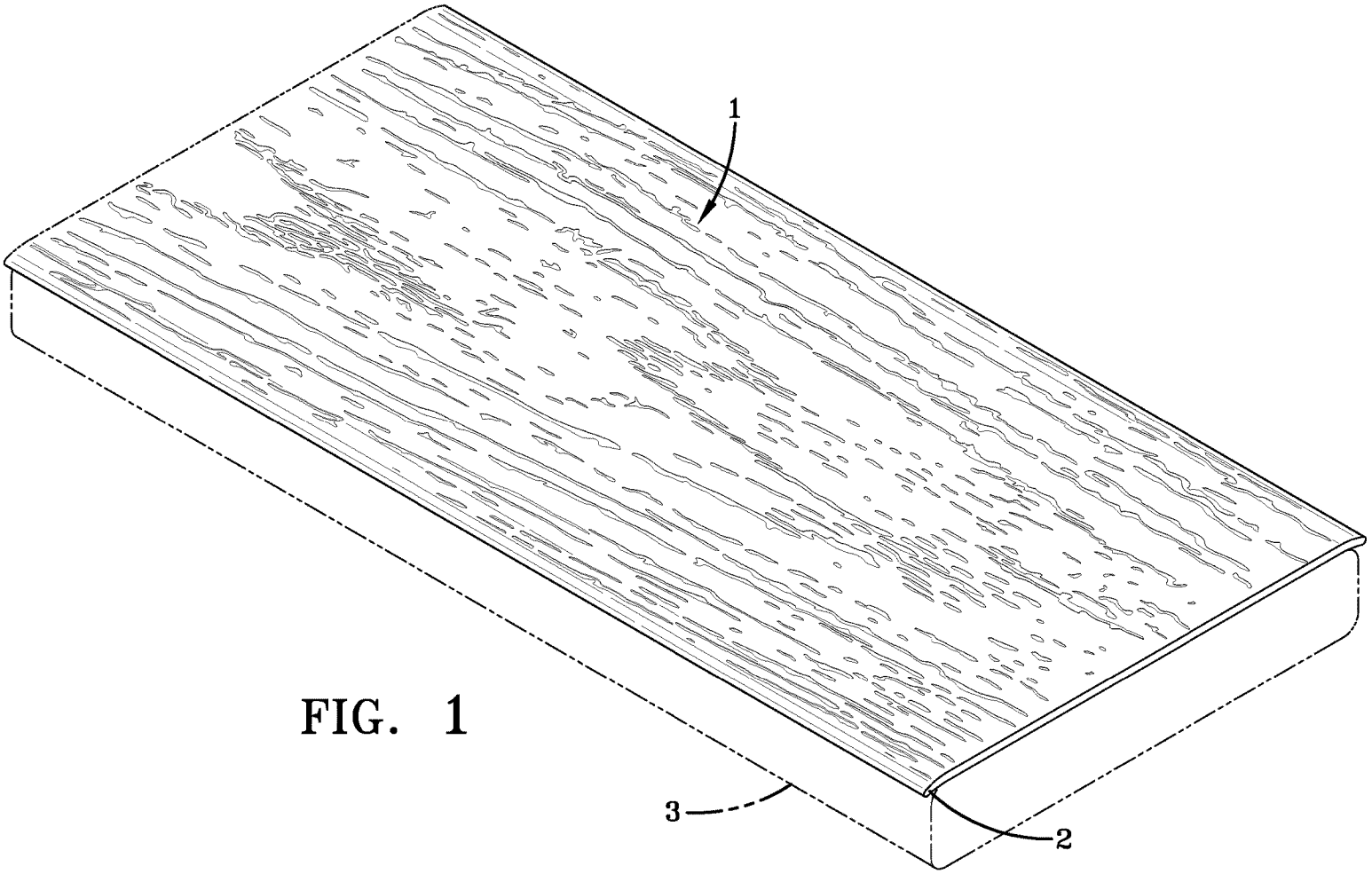
FIG. 1 is a top perspective view of the deck covering of this invention which is attached to a conventional deck plank.

The coverings of this invention can be created through extrusion, in which a thermoplastic polymer, preferably a plasticized polyvinyl chloride, is heated above its melting point and pushed (forced) through a dye to form the sheet. The polyvinyl chloride used in making the deck coverings of this invention will optimally be plasticized with a non-migrating plasticizer and will have a Shore A hardness which is within the range of 80 to 90 as measured with a durometer in accordance ASTM D2240 (type A). Polyvinyl chloride having a Shore A hardness of less than 80 is too soft to make a commercially viable product and polyvinyl chloride having a Shore A hardness of more than 90 is too hard. Polyvinyl chloride having a Shore A hardness which is within the range of 86 to 90 has proved to be an excellent choice for use in manufacturing the deck covering strips of this invention. As the sheet exits the dye, an embosser is used to imprint a design or pattern onto the deck covering. The design will typically be a simulated wood pattern, such as pine, maple, oak, ash, cedar, cherry, walnut, pecan, or the like. However, other desires patterns can also be embossed into the top surface of the deck covering to provide it with the desired pattern, such as diamonds, waves, circles, ovals, triangles, squares, stars, and the like. Embossing or imprinting will provide the deck covering with a non-slippery surface, and it can give the covering a texture which provides a wood-like appearance. After being extruded, a pressure sensitive adhesive can be applied to the underside of the deck coverings.

It is important for the bottom surface of the deck covering to be essentially flat to provide the maximum level of adhesion between the deck covering and the deck plank to which it will be applied. The bottom surface of the deck covering will also typically be free of slots or grooves which are detrimental to adhesion characteristics. For this reason it is highly desirable for the bottom surface of the deck covering to be free of longitudinal slots. The essentially flat bottom surface of the deck coverings of this invention allow for them to securely bond and adhere to the deck planks on which they will be applied. This allows for them to adhere to deck planks for years without curling, buckling, or otherwise delaminating under harsh outdoor conditions with exposure to rain, snow, ice, high winds, and extreme temperature variations.

The removable release liner keeps the adhesive from sticking to any surfaces or articles before the time that it is desired to affix the deck covering to a substrate (the deck being covered). This allows for the deck covering to be stored and transported without sticking to unintended objects. This peel and stick adhesive system eliminates the need for applying an adhesive to the underside of the deck covering at the point of installation. This in turn reduces labor requirements and the cost of applying the deck covering to a deck. The use of such a peel and stick pressure sensitive adhesive system is of particular benefit in the manufacture of new decks, having uniform and consistent deck surfaces. However, it is also of great value in covering existing decks, such as wood decks which have begun to deteriorate and/or discolor and plastic decks which have begun to discolor and/or which have become scratched or otherwise disfigured in an aesthetically undesirable manner.

The adhesive layer is comprised of a butyl rubber which is resistant to shear forces from foot-traffic, and which is durable and resistant to degradation from exposure to sunlight, heat, and moisture. The pressure sensitive adhesive layer is capable of close contact to the deck surfaces because it is formulated with a liquid hydrogenated resin, which allows for enhanced adhesion to irregular substrates. The polybutene used in the adhesive layer as a plasticizer is a highly hydrophobic raw material, and accordingly it provides a strong barrier to moisture and helps to maintain long lasting adhesion because of its inherent tackiness.

One or more thermal stabilizers can be added to the plastic composition used in making the body of the deck covering in an amount which is typically within the range of about 0.1 php to about 1 php to prevent thermal degradation during processing and throughout the service life of the deck covering. The thermal stabilizer will typically be an organometallic salt of tin, lead, barium, cadmium, calcium or zinc. Since the deck covering may be exposed to prolonged periods of harsh sunlight, an ultraviolet light stabilizer can also beneficially be utilized in the plastic composition. Benzophenones, benzotriazoles and substituted acrylonitriles are suitable for utilization as ultraviolet light stabilizers in polyvinyl chloride-based plastic compositions.

Figure 2:
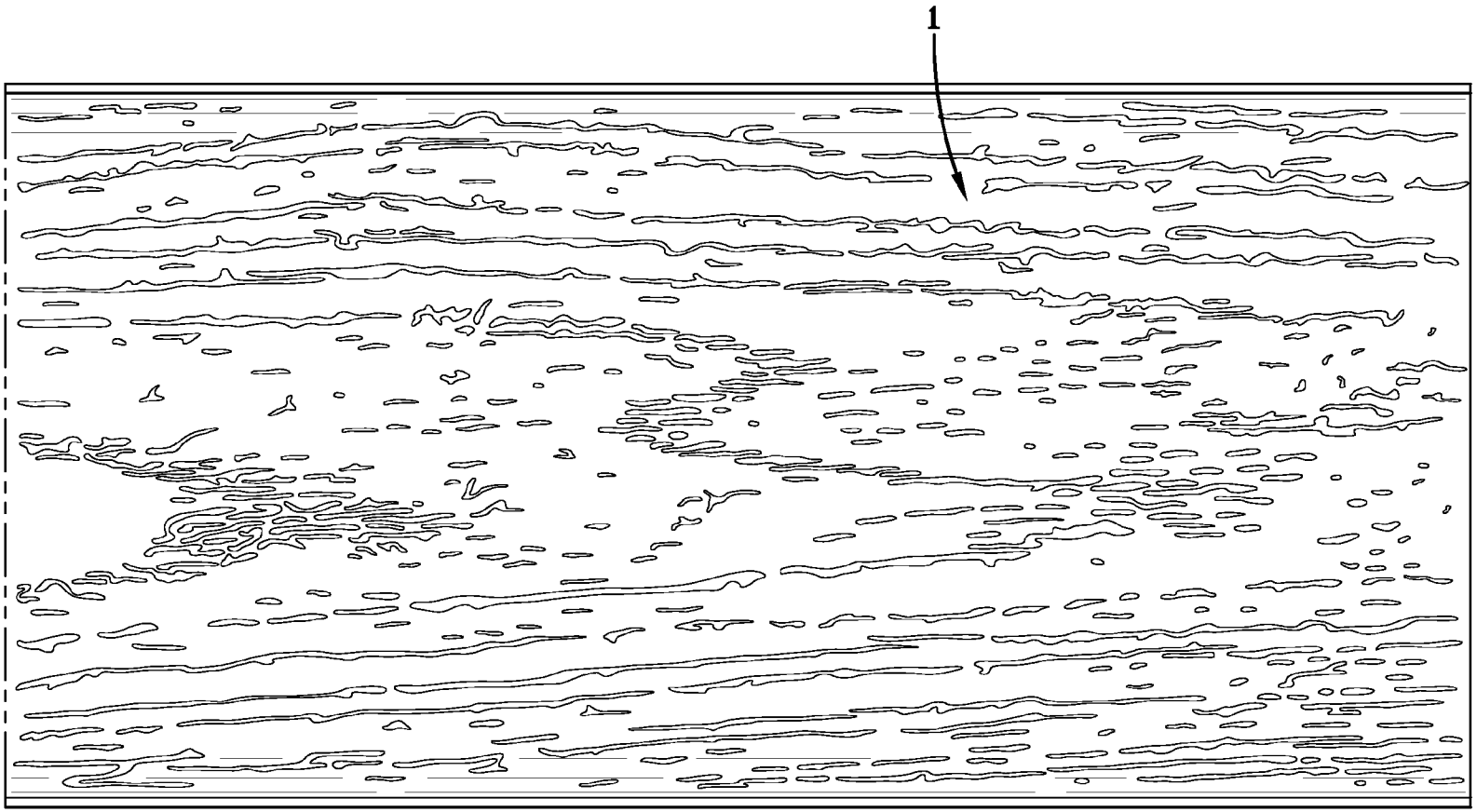
FIG. 2 is a top view of the deck covering of this invention.

The adhesive layer 4 used in the deck covering is comprised of several polymers including butyl rubber which has been heavily loaded with carbon black, and is preferably plasticized with polybutene. The carbon black will typically be included at a level of at least 50 phr (parts by weight per 100 parts by weight of rubber) and can beneficially be included at a level of 100 phr to 200 phr. The deck coverings can be manufactured using various coloring agents (organic compounds or inorganic pigments), and/or streaking agents to simulate a realistic wood appearance or any other desirable coloration. FIGS. 1 and 2 illustrate one example of a design or pattern that can be imprinted onto the top surface 1 of the deck coverings, to provide texture.

Figure 3:
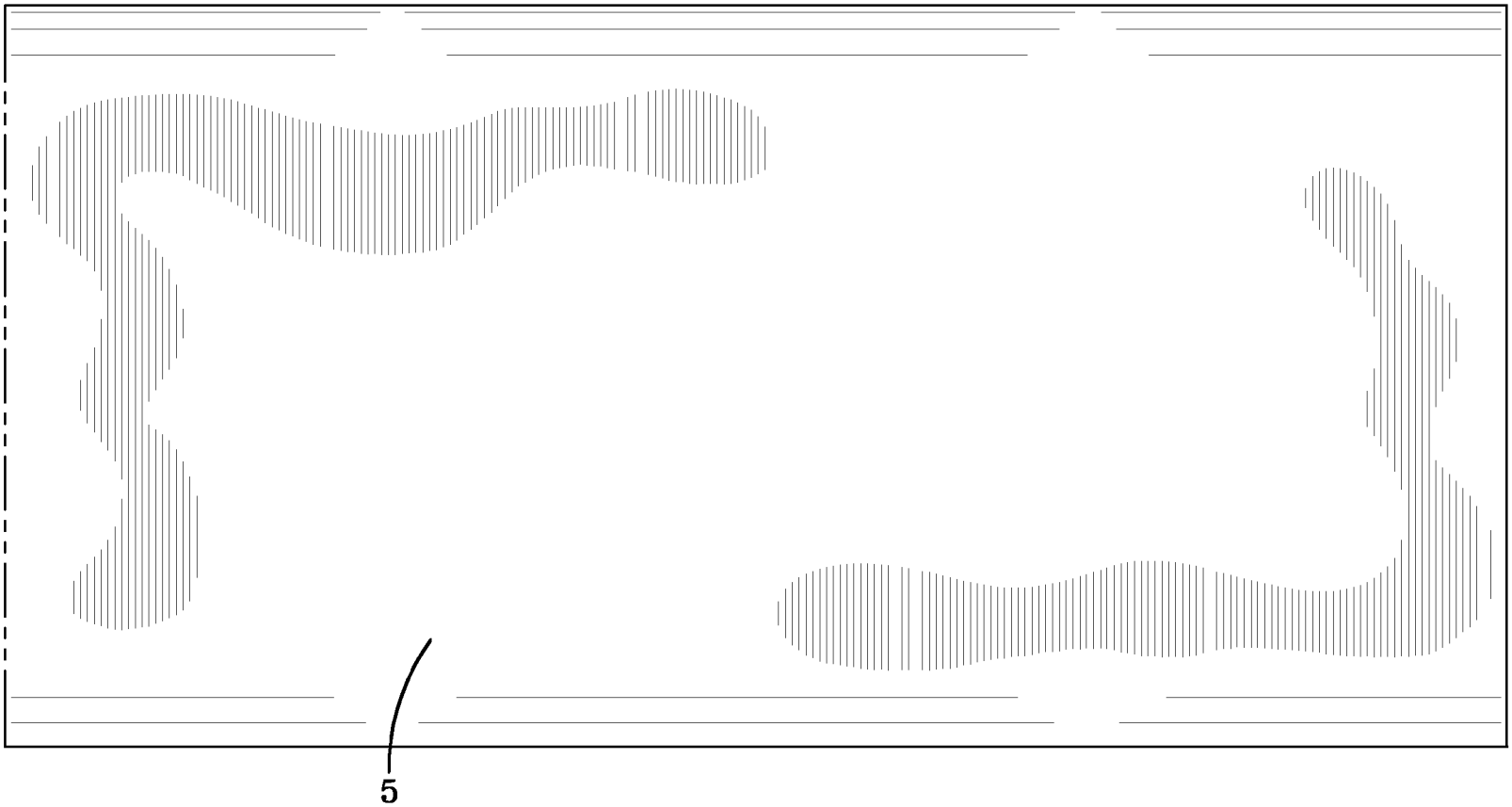
FIG. 3 is a bottom perspective view of the deck covering of this invention.
Figure 7:
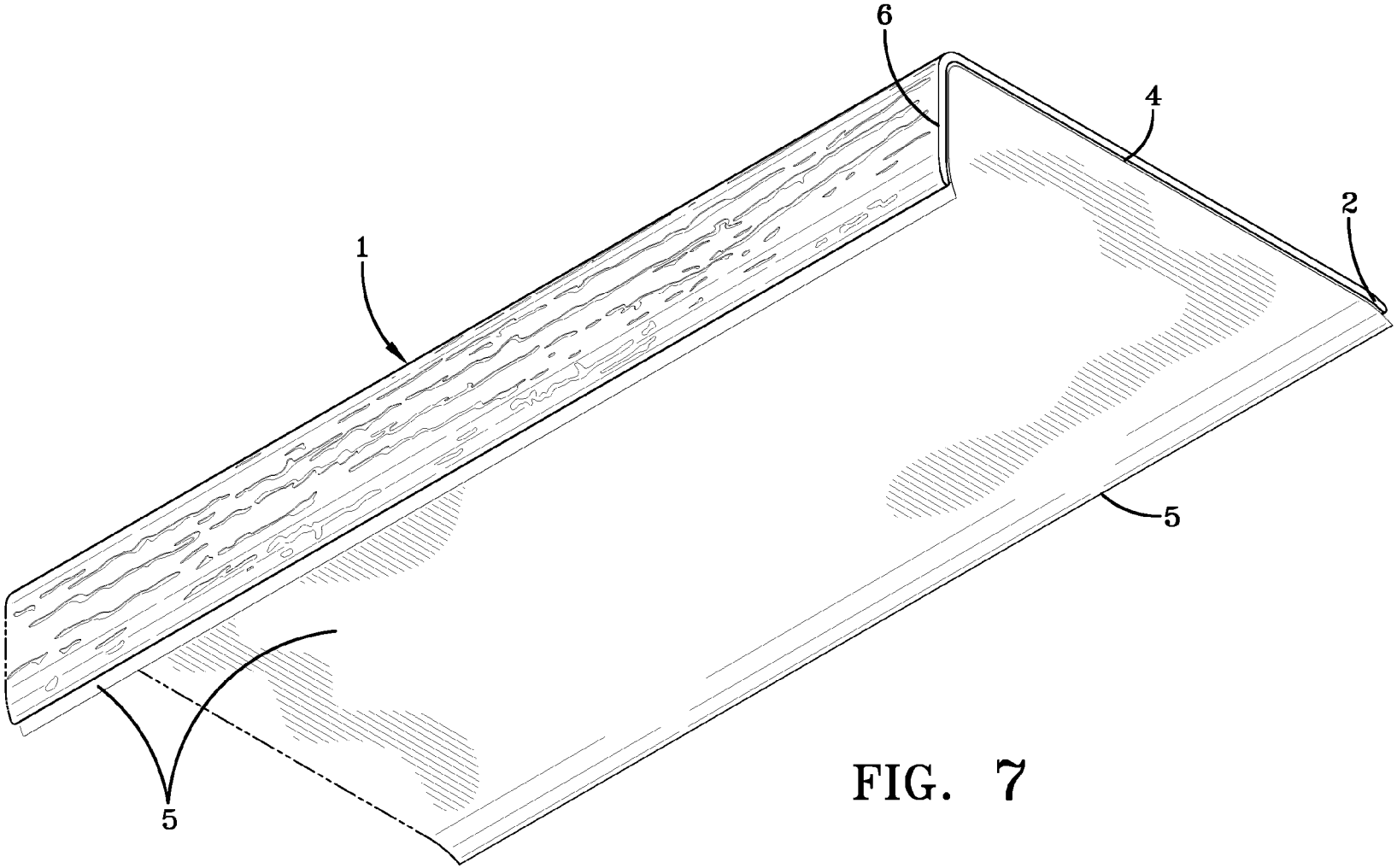
FIG. 7 is a bottom perspective view of the embodiment of the deck covering of this invention as illustrated in FIG. 6.

FIGS. 3 and 7 show bottom perspective views of two embodiments of the deck covering of this invention. The bottom surface of the invention includes a peel and stick adhesive layer 4, and a removable release liner 5, which may be comprised of polyester or waxed paper. The peel and stick adhesive layer 4 is comprised of butylene, carbon black, and an acrylic protective liner. In one embodiment of this invention, the deck covering adhesive 4 is comprised of an acrylic layer on the underside of the deck covering, a polybutylene layer, and then a second acrylic layer to affix the deck covering onto the deck plank 3. Typically the first and second acrylic layers will be 0.005 inches (0.13 mm) thick, the polybutylene layer will be 0.020 inches (0.51 mm) thick. Such a composite adhesive structure offers the advantage of being able to reposition the deck covering after it is initially positioned on a substrate for a short period of time. This is because the adhesive composite is initially bonded much more strongly to the deck covering than it is to the substrate (deck surface) to which it is being applied. It normally takes about 24 hours for the adhesive to fully cure to the substrate onto which it is being applied.

Figure 5:
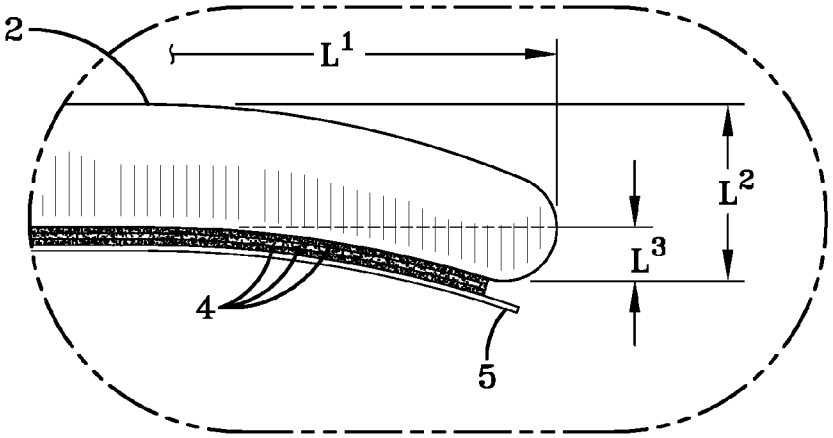
FIG. 5 shows a portion of the view provided in FIG. 4, which is magnified to more clearly show the layers of the peel and stick adhesive and the liner covering the peel and stick adhesive.
Figure 6:
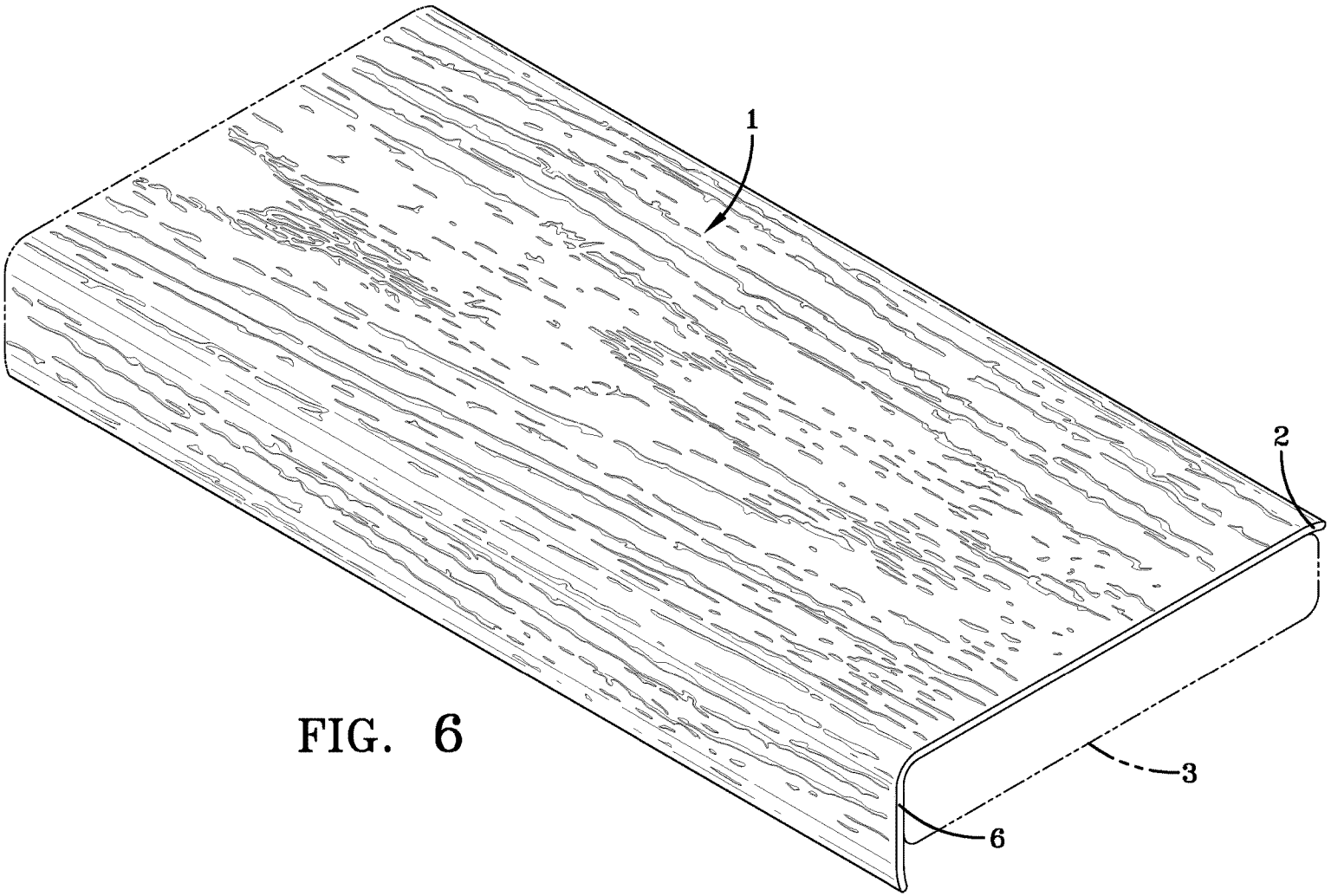
FIG. 6 is a top perspective view of one embodiment of this invention wherein the deck covering is affixed to a deck plank which is positioned at one end of a deck.

Both the front and back longitudinal edges of the deck covering are curved 2 in order to sufficiently cover the deck surface, to direct water runoff away from the underlying deck substrate, and to give the covered deck a more visually appealing appearance. The curved longitudinal edges 2 are generally between 0.05 inch (1.3 mm) and 1 inch long. In many cases the curved longitudinal edges will be within the range of 0.1 inch (2.5 mm) to 0.5 inch (13 mm) long. The length of the curvature of these longitudinal edges is shown as $L^1$ is FIG. 5. For instance, the curved longitudinal edges can be from 0.125 inch (3.1 mm) to 0.3 inch (7.6 mm) long, but these values are subject to change depending upon the type of deck surface that the coverings are designed to cover. The distance from the plane of the top surface of the deck covering to lowest point to which longitudinal edge of the deck covering extends is typically within the range of 0.125 inch (3.2 mm) to 0.375 inch (9.5 mm) and is shown in FIG. 5 as $L^2$. This length will frequently be within the range of 0.1 inch (2.5 mm) to 0.3 inch (7.6 mm). The deck coverings of this invention with typically be from 0.0625 inch (1.6 mm) to 0.3 inch (7.6 mm) thick. For a typical deck covering having a thickness of 0.125 inch (3.1 mm) the curved longitudinal edges will extend downwardly from 0.0625 inch (1.6 mm) to 0.25 inch (6.4 mm) and will typically extend downwardly 0.10 inch (2.5 mm) to 0.15 inch (3.8 mm). The downward curvature of the longitudinal edges of the deck covering can clearly be seen in FIG. 5 with the extent (distance) of the downward curvature being shown as $L^3$. This downward curvature $L^3$ will typically be within the range of 0.0625 inch (1.6 mm) to 0.3 inch (7.6 mm) and will more typically be within the range of 0.1 inch (2.5 mm) to 0.2 inch (5.1 mm). In many cases it has been found that it is optimal for this downward curvature $L^3$ to be within the range of 0.10 inch (2.5 mm) to 0.15 inch (3.8 mm). As can be seen most clearly in FIG. 5, the release liner 5 will typically extend beyond the adhesive layer 4 by about 0.125 inch (3.2 mm) to insure that all of the adhesive is covered and to facilitate the ultimate removal of the release liner 5. FIGS. 6 and 7 depict a deck covering with an elongated longitudinal edge 6, in order to cover the outer side of a deck plank located at the outer edges of the deck.

Figure 4:
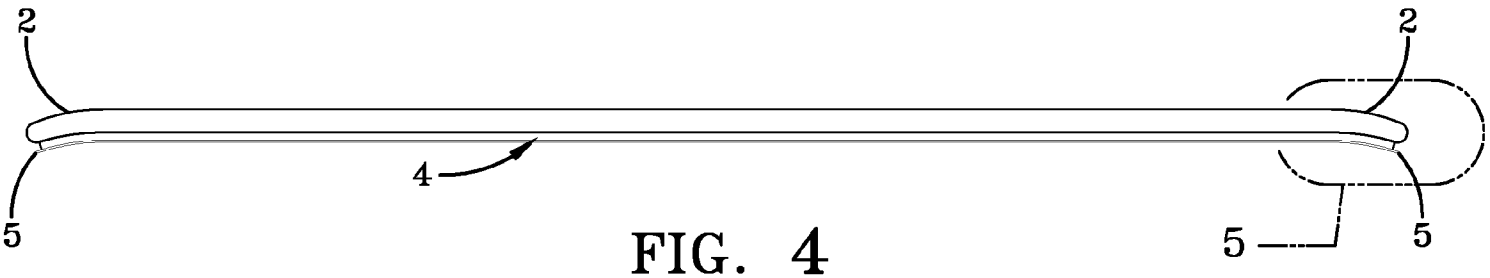
FIG. 4 is a right side view of the deck covering of this invention with the left side view being a mirror image of the right side view.

FIG. 4 illustrates the side view of one embodiment of a deck covering, and FIG. 5 represents a magnified area of the drawing in FIG. 4. FIG. 5 more clearly shows the curved longitudinal edge 2, the peel and stick adhesive layer 4, and the removable release liner 5 of the subject invention. The side view of FIG. 4 may be any width required to fully cover a deck surface. Typically, the deck coverings are between 3 inches (7.6 cm) and 12 inches (30.5 cm) wide, but they can be created at any width in order to sufficiently cover a deck surface. More typically, the deck coverings are 5.5 inches (14.0 cm) wide, to cover standard wood planks commonly used in decks. The deck coverings can also be 3.5 inches (8.89 cm), 7.5 inches (19.05 cm), 9.5 inches (24.13 cm), and 11.5 inches (29.21 cm) wide to cover an array of deck planks.

Optionally the thermoplastic material used in manufacturing the deck covering may include one or more antifungal agents (fungicides). Some representative types of anti-fungal agents that can be utilized include organo-copper compounds, organo-tin compounds, chlorinated phenols, and pentachlorophenol esters. Some specific examples of fungicides that can be used include copper naphthenate, copper-8-hydroxyquinolinate and pentachlorophenyl laurate. Irgaguard® F 3000 organic fungicide from Ciba Specialty Chemicals is specifically designed for inhibiting the growth of mold and mildew on polymer surfaces, such as PVC surfaces. The anti-fungal agent will typically be utilized in the plastic composition at a level which is within the range of about 0.5 php to about 2 php.

This invention is illustrated by the following example which is merely for the purpose of illustration and is not to be regarded as limiting the scope of the invention or the manner in which it can be practiced. Unless specifically indicated otherwise, parts and percentages are given by weight.

Example

In this procedure a deck covering was made in accordance with this invention. It was subsequently applied to a wood deck and evaluated. In the procedure used, polyvinyl chloride which was plasticized with a non-migrating plasticizer and which had a Shore A hardness of 88 as measured with a durometer in accordance ASTM D2240 (type A) was extruded into deck covering planks. A 3.5 inch (8.9 cm) single screw extruder was used in the extrusion and was operated at 30 revolutions per minute (rpm) utilizing a barrel temperature of 315° F. (157° C.) and a die temperature of 315° F. (157° C.). The extrusion rate was 15 feet per minute (4.6 meters per minute) with the extruded strips being 5.5 inches (38 cm) wide and 0.125 inch (3.2 mm) thick. Streakers were added through color feeders attached to the extruder to provide the deck covering with the desired natural wood coloring characteristics.

The extruded material was fed into a cold water embosser as it exited the die to provide the deck covering with the desired wood surface pattern (a pine grain pattern). After exiting the embosser the extruded sheet was passed through a water tank for cooling and was subsequently dried with air knives. After being dried the sheet was continuously passed through a laminator which applied double sided butyl rubber tape to the bottom side of the sheet. The deck covering made thereby was pulled through the extrusion line with a puller and wound onto spools having an outside diameter of 12 inches (30.5 cm) with the tape (bottom of the deck coverings) being on the outside of the rolls. The roll of deck covering was then removed from the spool as a roll for ease of handling.

The rolls of deck covering were then unrolled into strips which were cut to length for application to a wooden deck at a residence in northeastern Ohio. The strips of deck covering were applied to the deck by removing the removable release liner from the underside of deck covering strips to expose the adhesive. The deck covering strips were then applied to the wooden planks of the deck so as to bring the adhesive on the bottom side of the deck covering strips into contact with the wooded planks of the deck. The simulated wood deck covering strips were then allowed to adhere to the planks of the deck.

The deck covering applied to the deck provided it with a beautiful wood-like appearance. The beautiful appearance of the deck covering withstood the outdoor elements for two years without any evidence of deterioration. Exposed to sunlight, rain, snow, and extreme fluctuations in temperature did not appear to adversely affect the deck covering or its adherence to the wood deck. After two years the deck covering looked as good as it did the day on which it was applied. It is contemplated that the deck covering of this invention will provide a beautiful outdoor deck surface for many years to come without the need for any type of maintenance.

Variations in the present invention are possible in light of the description of it provided herein. While certain representative embodiments and details have been shown for the purpose of illustrating the subject invention, it will be apparent to those skilled in this art that various changes and modifications can be made therein without departing from the scope of the subject invention. It is, therefore, to be understood that changes can be made in the particular embodiments described which will be within the full intended scope of the invention as defined by the following appended claims.

What is claimed is:

1. A deck covering consisting of a top surface, a bottom surface, a front side longitudinal edge, a back side longitudinal edge, and a peel and stick adhesive, wherein the deck covering is made of a thermoplastic material, wherein the top surface is textured to provide a non-slip surface, wherein the bottom surface is covered with the peel and stick adhesive, wherein the front side longitudinal edge is curved downwardly along the entire length of the deck covering, has a length of curvature which is within the range of 0.05 inch to 0.3 inch, has a distance from the top surface of the deck covering to the lowest point to which the longitudinal edge of the deck covering extends which is within the range of 0.1 inch to 0.3 inch, and has a downward curvature which is within the range of 0.0625 inch to 0.3 inch, and wherein the back side longitudinal edge is curved downwardly along the entire length of the deck covering, has a length of curvature which is within the range of 0.05 inch to 0.3 inch, has a distance from the top surface of the deck covering to the lowest point to which the longitudinal edge of the deck covering extends which is within the range of 0.1 inch to 0.3 inch, and has a downward curvature which is within the range of 0.0625 inch to 0.3 inch.

2. The deck covering as specified in claim 1, wherein the thermoplastic material is comprised of a non-migrating plasticizer.

3. The deck covering as specified in claim 1, wherein the peel and stick adhesive is comprised of a butyl rubber adhesive.

4. The deck covering as specified in claim 1, wherein the peel and stick adhesive includes a protective liner.

5. The deck covering as specified in claim 4, wherein the protective liner is acrylic.

6. The deck covering as specified in claim 1, wherein the peel and stick adhesive includes a removable release liner.

7. The deck covering as specified in claim 6, wherein the removable release liner is comprised of polyester or waxed paper.

8. The deck covering as specified in claim 1, wherein the thermoplastic material includes a fungicide.

9. The deck covering as specified in claim 1, wherein the top surface of the covering is embossed to resemble wood.

10. The deck covering as specified in claim 1, wherein the deck covering is between 3 inches and 12 inches wide.

11. The deck covering as specified in claim 1 wherein the peel and stick adhesive structure is comprised of an acrylic layer, a butyl adhesive layer, and a second acrylic layer which is covered with a removable release liner.

12. The deck covering as specified in claim 1 wherein the deck covering is in the form of a strip, and wherein the peel and stick adhesive structure is comprised of an adhesive layer and a removable release liner, wherein the adhesive layer is comprised of a butyl rubber, carbon black, and polybutene.

13. The deck covering as specified in claim 1 wherein the deck covering is in the form of a strip, and wherein the front side longitudinal edge is curved downwardly from 0.0625 inch to 0.25 inch.

14. The deck covering as specified in claim 1 wherein the deck covering is in the form of a strip, and wherein the front side longitudinal edge is curved downwardly 0.10 inch to 0.15 inch.

15. The deck covering as specified in claim 1 wherein the bottom surface of the deck covering is essentially flat.

16. The deck covering as specified in claim 1 wherein the deck covering has a Shore A hardness which is within the range of 80 to 90 as measured with a durometer in accordance ASTM D2240-02.

17. The deck covering as specified in claim 1 wherein the deck covering is capable of being rolled onto spools having a 12 inch outside diameter.

18. A deck which is comprised of a support structure and a plurality of planks which form the surface of the deck, wherein the upper surface of each plank is covered with a deck covering consisting of a top surface, a bottom surface, a front side longitudinal edge and a back side longitudinal edge, wherein each plank in the plurality of planks is covered by a separate deck covering, wherein each deck covering is made of a thermoplastic material, wherein the top surface is embossed to provide a non-slip surface, wherein the front side longitudinal edge of each deck covering is curved downwardly and overhangs the edges of the planks over the entire length of plank that each respective deck covering covers, has a length of curvature which is within the range of 0.05 inch to 0.3 inch, and has a downward curvature which is within the range of 0.0625 inch to 0.3 inch, and wherein the back side longitudinal edge of each deck covering is curved downwardly and overhangs the edges of the planks over the entire length of plank that each respective deck covering covers, has a length of curvature which is within the range of 0.05 inch to 0.3 inch, and has a downward curvature which is within the range of 0.0625 inch to 0.3 inch.

19. A method of covering deck planks which form the surface of a deck with a protective and decorative deck covering, said method comprising (1) providing a plurality of deck coverings as specified in claim 6, wherein the deck coverings are adapted to cover the surface of planks of the deck and are in the form of strips; (2) removing the removable release liner from said strips of the deck coverings to expose the adhesive, (3) bringing the adhesive on the strips of the deck coverings into contact with the planks, (4) allowing the strips to adhere to the planks of the deck.

* * * * *